US005179416A

United States Patent [19]

Ku et al.

[11] Patent Number: 5,179,416

[45] Date of Patent: Jan. 12, 1993

[54] METHOD AND APPARATUS FOR CLEANING AND RENEWING AN ELECTROSTATOGRAPHIC IMAGING SURFACE

[75] Inventors: Wayne W. Ku, Rochester; Dean R. Smith, Conesus, both of N.Y.

[73] Assignee: Eastman Kodak Company, Rochester, N.Y.

[21] Appl. No.: 812,331

[22] Filed: Dec. 23, 1991

[51] Int. Cl.[5] ..... G03G 21/00

[52] U.S. Cl. ..... 355/297

[58] Field of Search ..... 355/296, 297, 304, 302, 355/303, 305, 306, 299; 118/652

[56] References Cited

U.S. PATENT DOCUMENTS

| | | | |
|---|---|---|---|
| 3,910,697 | 10/1975 | Lanker | 355/296 X |
| 3,947,108 | 3/1976 | Thettu et al. | 355/297 |
| 4,078,924 | 3/1978 | Keddie et al. | 118/652 X |
| 4,279,500 | 7/1981 | Kondo et al. | 118/652 X |
| 4,364,329 | 12/1982 | Murai et al. | 118/652 |
| 4,395,113 | 7/1983 | Buchan et al. | 355/297 |
| 4,870,465 | 9/1989 | Lindblad et al. | 355/296 |
| 4,878,093 | 10/1989 | Edmunds | 355/296 |
| 4,931,841 | 6/1990 | Yoshihara | 355/299 |
| 4,974,030 | 11/1990 | Tokunaga et al. | 355/296 |

FOREIGN PATENT DOCUMENTS

| | | | |
|---|---|---|---|
| 0176083 | 10/1982 | Japan | 355/297 |
| 0095772 | 6/1983 | Japan | 355/297 |
| 0111673 | 6/1984 | Japan | 355/297 |
| 0232379 | 12/1984 | Japan | 355/297 |
| 0151982 | 6/1988 | Japan | 355/297 |
| 0161284 | 6/1989 | Japan | 355/297 |

*Primary Examiner*—A. T. Grimley
*Assistant Examiner*—William J. Royer
*Attorney, Agent, or Firm*—Tallam I. Nguti

[57] ABSTRACT

A combination cleaning and surface renewing apparatus includes a cleaning member for removing residual particles from the image-bearing surface of electrostatographic reproduction apparatus. The combination apparatus also includes a first abrading member mounted downstream of the cleaning member for removing at least an atomic layer of material forming the image-bearing surface. The first abrading member is impregnated with abrasive aluminum oxide particles. The combination apparatus also includes a second abrading member mounted downstream of the first abrading member for polishing and renewing the abraded image-bearing surface. The second abrading member includes particles of colorless toner particles chemically bonded therein.

12 Claims, 2 Drawing Sheets

METHOD AND APPARATUS FOR CLEANING AND RENEWING AN ELECTROSTATOGRAPHIC IMAGING SURFACE

BACKGROUND OF THE INVENTION

1. Field of the Invention

The present invention relates to cleaning apparatus and methods for removing residual toner and other particles from an image-bearing surface of an electrostatographic reproduction machine such as a copier or printer. More particularly, the present invention relates to such an apparatus and method that is suitable for cleaning and renewing such an image-bearing surface.

2. Description Relative to the Prior Art

Electrostatographic process reproduction machines such as copiers and printers for producing copies of an original document are well known. Such copies typically are produced on suitable receivers through a repeatable process that normally includes the steps of (1) using electrostatic charges in some manner to form a latent image on the surface of an image-bearing member; (2) developing the latent image with developer material that includes toner particles; (3) transferring the developed image to a suitable receiver for subsequent fusing; and (4) cleaning the image-bearing surface thereafter by removing residual toner and other particles therefrom in preparation for repeating the process steps.

The quality of the copies obtained by repeating these steps depends significantly on the effectiveness of the cleaning device or apparatus that is employed for cleaning and preparing the image-bearing surface for such reuse. Such cleaning and preparation should involve not only removing the residual toner and other particles left on the image-bearing surface after the image transfer step, but also renewing such surface by removing therefrom chemical and/or physical contamination such as scum. Conventional cleaning apparatus for removing the particles and attempting to also remove the chemical contamination include, for example, sponge roller and blade cleaners as disclosed for example in U.S. Pat. No. 4,395,113, issued Jul. 26, 1983 in the name of Buchan et al, and blade and scrubber pad cleaners as disclosed for example in U.S. Pat. No. 3,947,108, issued Mar. 30, 1976 in the name of Thettu et al. In the '108 patent the need for renewing the surface is recognized, and means for doing so are disclosed including scrubbing or abrading the surface of the image-bearing member with a scrubbing pad in order to remove film-like contamination therefrom. The means or apparatus disclosed includes a single cleaning element such as a blade, and a single abrasive element such as a pad or roller consisting of fibers made preferably from cotton or from other fabrics such as felt or polyurethane. Importantly, it is recognized in the '108 patent that such an apparatus may fail to remove the film-like contamination if not mechanically biased precisely against the image-bearing surface, or if overbiased it may undesirably abrade such surface excessively. Given the particular scrubbing materials and method disclosed in the '108 patent, the apparatus disclosed therein is therefore likely to suffer from loading imprecision as the surface becomes abraded or worn out in the process. Additionally, the surface is also likely to suffer from surface scratches or abrasive marks, both of which can result from abrading the surface, and are likely to cause defects in the images produced on such surface.

SUMMARY OF THE INVENTION

In accordance with the present invention, a combination apparatus is provided for cleaning and renewing the image-bearing surface of a moving image-bearing member of an electrostatographic reproduction machine. The combination apparatus comprises first means including a cleaning member for removing residual particles from the image-bearing surface, and second means which is located relative to the movement of the imaging member downsteam of the first means, for abrading the image-bearing surface so as to remove at least an atomic layer of material forming such surface. The second means includes a first abrading member that has first abrasive means built therein. The combination apparatus further includes third means which is located relative to the movement of the imaging member downstream of said second means for polishing and renewing the abraded imaging surface so as to substantially erase printable scratches from such surface.

BRIEF DESCRIPTION OF THE DRAWINGS

In the detailed description of the invention presented below, reference is made to the drawings, in which.

DETAILED DESCRIPTION OF THE PREFERRED EMBODIMENT

Because electrostatographic reproduction apparatus are well known, the present description will be directed in particular to elements forming part of or cooperating more directly with the present invention. Elements of such apparatus not specifically shown or described herein are assumed selectable from those known in the prior art.

Figure 1:
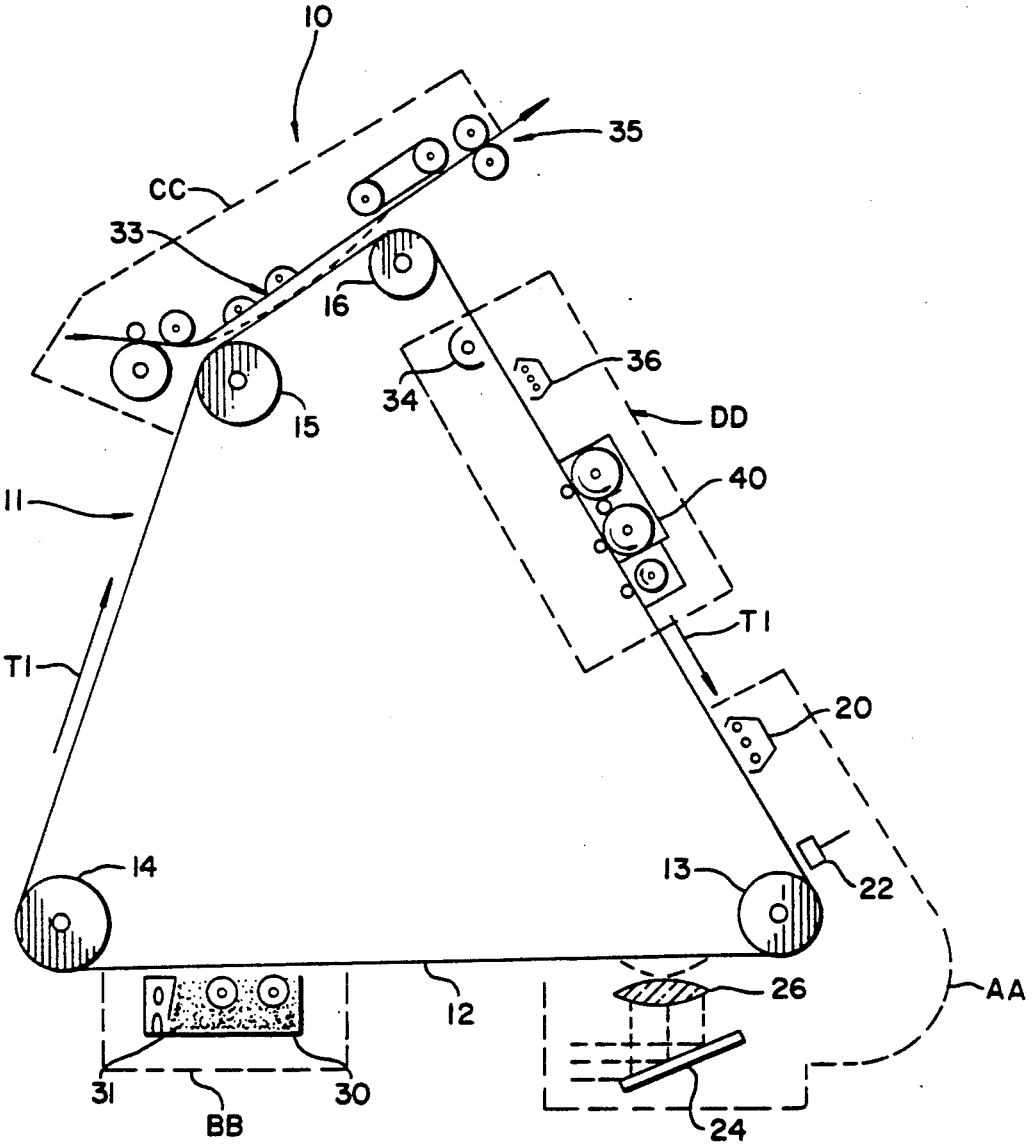
FIG. 1 is a schematic illustration of an electrostatographic reproduction machine such as an optical copier including the combination cleaning apparatus of the present invention.

Referring now to FIG. 1, an electrostatographic reproduction machine such as an optical copier is shown generally as 10, and includes an image-bearing member 11 which has a frontside image-bearing surface 12. As shown, the member 11 is trained about a series of rollers 13 through 16 for movement in the direction, for example, of the arrow T1. One of the rollers, such as the roller 13, can be a drive roller, suitably driven by a conventional drive (not shown) for repeatedly moving the member 11 through a series of electrostatographic process stages shown as AA, BB, CC and DD. Although the member 11 is shown as an endless flexible web trained about the series of rollers, it should be understood that a rigid drum, having an image-bearing surface, can also be used.

As shown in FIG. 1, clean and charge-free portions of the image-bearing member 11 for example, initially move through the stage AA where electrostatic charges and/or light, are used in one manner or another (as is well known in the art) to electrostatically form latent images of an original document on the surface 12. Typically, the stage AA includes contamination sensitive components such as a primary charger 20 or other charge depositing component (not shown). The electrostatic image of the original document can thus be formed on the surface 12, for example, by charging the surface 12 using the primary charger 20, and then image-wise discharging portions of such surface using an electronic printhead 22 and/or an optical system. A typical optical system has a light source (not shown) that illuminates a sheet of the original document placed on a platen such that light rays reflected from the sheet are in turn reflected by a mirror 24 through a lens 26, to the surface 12 thereby image-wise exposing or imaging such portion.

The imaged portion of the image-bearing surface 12 next moves to stage BB where the latent image thereon is developed, that is, is made visible with charged particles of toner. Stage BB normally includes a development station 30 that contains a developer material 31 which may comprise such toner particles only, or of a mixture of oppositely charged magnetic carrier particles and such toner particles. At the development station 30, development is achieved when the toner particles of the developer material 31 transfer to the image-bearing surface 12 and there adhere to the electrostatically formed image, thereby making such image thereon visible.

After such development, that portion of the image-bearing surface 12 carrying the toner developed or visible image thereon, next moves to the stage CC. Stage CC usually includes a toner image transfer station 33 where the visible toner image on the surface 12 is transferred to a suitable receiver such as a sheet of paper which is fed in registration to the station 33 along a sheet travel path. Typically, such image transfer is effected electrostatically as well as by contact and pressure within a transfer nip. After such image transfer, the copy sheet then travels to a fusing station 35, as shown, where the image is permanently fused to the receiver sheet thereby forming a permanent copy, while the member 11 meantime moves on about the series of rollers 13 through 16 towards the initial stage AA to begin another imaging cycle.

On leaving the image transfer station 33, each portion of the surface 12 on which a toner image has been formed and transferred as described above ordinarily will be contaminated with residual charges as well as with residual particles, principally residual toner particles. Additionally, the pressures and process heat at the various stations for example the image transfer station through interaction with the residual particles ordinarily result in chemical contamination such as scum and black spots on the surface 12. To ensure the continued production of high quality images and copies during subsequent cycles of the imaging process, it is necessary therefore to effectively clean, that is, to effectively remove such residual toner particles and chemical contamination from each such used portion of the surface 12. Accordingly, such cleaning is carried out at stage DD where apparatus or devices are located for removing the residual charges and particles as well as renewing the surface 12. As shown for example, the residual charges can be removed by a discharge lamp 34 and/or neutralized by a corona 36, and the residual toner particles and chemical contamination can be removed by the combination cleaning and surface renewing apparatus of the present invention shown generally as 40.

Figure 2:
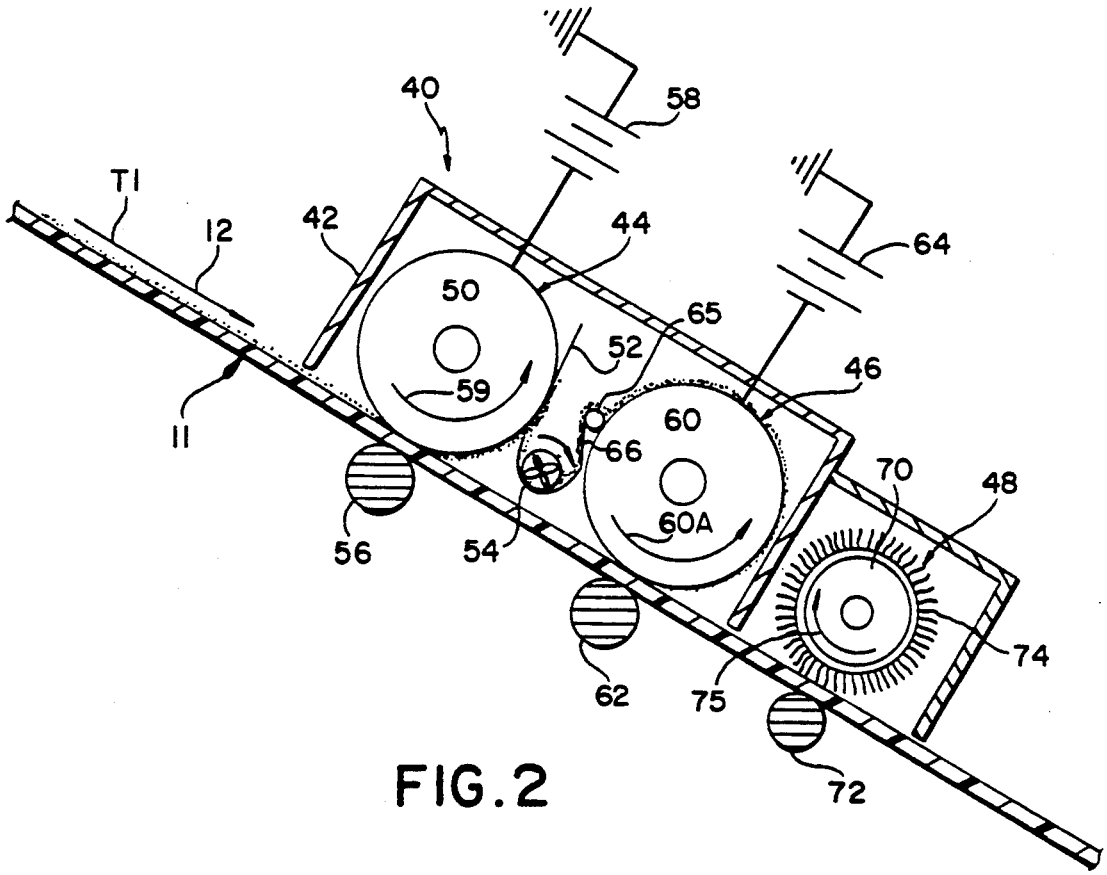
FIG. 2 is an enlarged illustration (partly in section) of the combination cleaning apparatus of FIG. 1 showing the surface cleaning and renewing means of the present invention.

Referring now to FIG. 2, the combination cleaning and surface renewing apparatus 40 is shown in detail and comprises (a) a housing 42, (b) a first means 44 for cleaning or removing residual particles from the surface 12, (c) a second means 46 for abrading the surface 12 so as to remove at least an atomic layer of material forming on such surface 12, and (d) a third means 48 for polishing and renewing such surface 12 before it is again reused in the imaging process as described above.

As shown, the first means 44, which is adapted to remove charged and uncharged residual particles from the moving surface 12, is mounted inside the housing 42. First means 44 as mounted includes a cleaning member such as a cleaning roller 50 which is made from compliant silicone rubber, for example, that is filled with or has dispersed therein fine non-abrasive carbon particles so as to make the roller 50 electrically conductive. The size of the carbon particles should be selected, and the roller 50 should be made, such that the roller 50 has a smooth surface which has a roughness factor Ra of ten micro inches (10μ in.) or less. Such a surface roughness effectively does not abrade the surface 12 and also allows secondary cleaning of the roller 50 for example with a blade. For such secondary cleaning, the first means 44 includes a scraping blade 52 which is mounted so as to scrape residual particles from the surface of the roller 50 into a transport auger shown as 54. The auger 54 as such transports the residual particles away from the cleaning area for disposal.

The cleaning apparatus 40 is mounted within the reproduction apparatus 10 such that the cleaning roller 50 makes cleaning contact with the moving surface 12 with the backside of the web 11 being supported over a back-up roller 56. For effective removal of charge and uncharged residual particles from the surface 12, the cleaning roller 50 as shown is electrically biased by a source 58, for example, to a negative polarity, which polarity should preferably be relatively opposite to the polarity of the residual toner particles to be removed from the surface 12. In addition, the surface of roller 50 is preferably driven actively by means (not shown) in the direction of the arrow 59 for example, and at a speed that is different from that of the moving surface 12. Preferably, too, the surface of roller 50 should be driven as such at a speed that is slower than that of the surface 12.

As also shown, the second means 46 is located downstream of the cleaning roller 50 relative to the direction of movement of the surface 12. Second means 46 is suitable for removing chemical contamination such as black spots and scum from the surface 12. Such chemical contamination for example results from unpredictable interaction between toner and paper dust particles under conditions of processing pressure and heat occurring for example during image transfer and/or during surface cleaning. To remove such chemical contamination requires that at least an atomic layer of the material forming the surface 12 be removed Accordingly, in order to accomplish such layer removal, the second means 46 includes a combination cleaning and first abrasion member such as a roller 60 that is mounted within the housing 42 so as to contact the surface 12 with the backside of the web 11 being supported over a backup roller 62. The combination roller 60 is made for example from silicone rubber that is filled with or has dispersed therein fine non-abrading carbon particles for electrical conductivity, and that is impregnated with a first type of abrasive particles that each have substantially a first size for example, such a first type of abrasive particles may comprise aluminum oxide particles having a size suitable for lightly abrading, that is wearing into the surface 12 so as to remove at least an atomic layer therefrom. For such abrasion, the abrasive particles should be selected so as to give the roller 60 a surface roughness factor, Ra, of about 250μ in. The combination roller 60 as shown is electrically biased by a source 64 which may have the same polarity as the source 58.

Roller 60 should be actively driven by drive means (not shown) in the direction for example of the arrow 60A so as to lightly contact the surface 12, and its surface should have a speed that is also different from the speed of the surface 12. Preferably, the combination abrading and cleaning roller 60 should be driven such that its surface moves at a speed which is slower than that of the surface 12. In order to reduce the likelihood of the abrading roller 60 generating surface or printable scratches in the surface 12 as a result of its abrading action, the roller 60 should be made sufficiently large so as to form an abrading footprint or nip of at least four millimeters (4 mm.) with the surface 12. As shown, residual particles and abraded debris removed by the combination roller 60 from the surface 12 can be removed therefrom by a compliant roller 65 which is then scraped by a blade 66, and into the auger 54.

As further shown, the third means 48 of the apparatus 40 is comprised of a rotatable fiber brush 70. The brush 70 is located to contact the already abraded surface 12 with the back of the web 11 being supported over a backup roller 72 at a location downstream of the combination cleaning and abrading roller 60. The brush 70 may comprise fine acrylic fibers 74, for example, which are chemically sprayed or coated with a second type of abrasive particles having a second size that preferably is finer than the size of the first type of abrasive particles of the abrading roller 60. The second type of abrasive particles for example may be particles of colorless toner of a size sufficient to produce an equivalent surface roughness Ra of about 50μin. Such particles of toner may also be triboelectrically and physically trapped in, as opposed to being chemically sprayed onto, the acrylic fibers 74 of the brush 70. In either case, the brush 70 is loaded and driven, for example in the direction of the arrow 75, against the abraded surface 12 so as to polish and hence renew such surface 12 thereby substantially erasing and eliminating any printable scratches thereon that may have resulted for example from abrading the surface 12 with the abrading roller 60 of second means 46.

As can be seen, the combination cleaning and surface renewing apparatus 40 of the present invention comprises materials and structures that are adapted to effectively remove charged and uncharged residual particles from the imaging surface 12 of a copier or printer 10, as well as, to remove chemical contamination therefrom. Advantageously, the combination apparatus 40 of the present invention also polishes and effectively renews such imaging surface 12 by substantially erasing and eliminating any printable scratches on such surface which may have resulted for example during removal of the chemical contamination from such surface.

The invention has been described in detail with particular reference to a presently preferred embodiment, but it will be understood that variations and modifications can be effected within the spirit and scope of the invention.

What is claimed is:

1. A combination apparatus for cleaning and renewing an imaging surface of a moving image-bearing member of an electrostatographic reproduction machine, the combination apparatus comprising:

(a) first means including a cleaning member for removing residual particles from an imaging surface;

(b) second means located downstream of said cleaning member relative to movement of the image bearing member, said second means including a first abrading member having a first abrasive means thereon for abrading such imaging surface so s to wear off a layer of material that forms part of such imaging surface; and (c) third means located downstream of said second means, said third means including a second abrading member having second abrasive means thereon for polishing and renewing such abraded imaging surface so as to substantially erase and eliminate printable scratches therefrom.

2. The combination apparatus of claim 1 wherein said cleaning member of said first means is a rotatable cleaning roller in cleaning contact with the imaging surface.

3. The combination apparatus of claim 1 wherein said cleaning member of said first means is electrically biased to a first polarity opposite to a polarity of charged residual particles to be removed by said first means from the imaging surface.

4. The combination apparatus of claim 1 wherein said first abrading member of said second means is a rotatably driven roller.

5. The combination apparatus of claim wherein said first abrading member of said second means is electrically biased to a polarity relatively the same as a biasing polarity for said cleaning member of said first means.

6. The combination apparatus of claim 1 wherein said first abrasive means of said first abrading member consists of aluminum oxide particles.

7. The combination apparatus of claim 1 wherein said second abrasive means of said second abrading member of said third means consists of colorless toner particles.

8. The combination apparatus of claim 1 wherein said abrasive means of said second abrading member of said third means consists of particles a second size that is finer than the size of abrasive particles of said first abrasive means of said first abrading member of said second means.

9. The combination apparatus of claim 4 wherein said rotatably driven roller is driven so as to contact the moving imaging surface at a speed slower than the speed of such moving imaging surface.

10. The combination apparatus of claim 7 wherein said colorless toner particles are chemically spray-coated on fibers of said second abrading member.

11. A combination method for cleaning and renewing the imaging surface of a moving image-bearing member of an electrostatographic reproduction machine, the method comprising the steps of:

(a) engaging the imaging surface with a cleaning member for removing residual particles from the imaging surface;

(b) engaging the cleaned imaging surface with a first abrading member having first abrasive means thereon for wearing off least an atomic layer of material forming the imaging surface; and (c) engaging the abraded imaging surface with a second abrading member having a surface roughness less than that of said first abrading member for polishing and renewing the abraded imaging surface by erasing and substantially eliminating printable scratches from such surface.

12. The method of claim 11 wherein the step of wearing off an atomic layer of the imaging surface includes actively driving said first abrading member to contact the moving imaging surface at a speed that is slower than that of the imaging surface.

* * * * *